US012616355B2

(12) United States Patent
Brolley

(10) Patent No.: US 12,616,355 B2
(45) **Date of Patent: *May 5, 2026**

(54) ANGLED LEADING SIDE FOR A TRIGGER HEAD OF A SLIDE ASSEMBLY

(71) Applicant: Haier US Appliance Solutions, Inc., Wilmington, DE (US)

(72) Inventor: Justin James Brolley, New Albany, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 262 days.

This patent is subject to a terminal disclaimer.

(21) Appl. No.: 18/488,622

(22) Filed: Oct. 17, 2023

(65) Prior Publication Data

US 2025/0120565 A1 Apr. 17, 2025

(51) Int. Cl.
*A47L 15/50* (2006.01)
*A47L 15/22* (2006.01)

(52) U.S. Cl.
CPC ..... *A47L 15/507* (2013.01); *A47L 15/22* (2013.01)

(58) Field of Classification Search
CPC ..... A47L 15/22; A47L 15/507; A47B 88/473; A47B 2088/401
USPC ..... 312/228.1
See application file for complete search history.

(56) References Cited

U.S. PATENT DOCUMENTS

| | | | | |
|---|---|---|---|---|
| 3,799,640 | A * | 3/1974 | Jacobs | E05B 65/463 312/273 |
| 7,377,500 | B2 | 5/2008 | Tomiji et al. | |
| 7,607,444 | B2 | 10/2009 | Gunnerson et al. | |
| 7,945,993 | B2 | 5/2011 | Tomioka et al. | |
| 8,205,951 | B2 | 6/2012 | Boks | |
| 8,387,634 | B2 | 3/2013 | Dalsing | |
| 8,393,693 | B2 | 3/2013 | Juan et al. | |
| 8,414,094 | B2 | 4/2013 | Chi et al. | |
| 8,419,142 | B2 | 4/2013 | Zimmermann | |
| 8,449,051 | B2 | 5/2013 | Lam et al. | |
| 8,459,758 | B2 | 6/2013 | Rechberg et al. | |
| 8,511,764 | B1 | 8/2013 | Chen | |
| 8,888,200 | B2 | 11/2014 | Sato | |
| 8,939,525 | B1 | 1/2015 | Chen | |

(Continued)

FOREIGN PATENT DOCUMENTS

| | | | |
|---|---|---|---|
| JP | 2015116452 | A | 6/2015 |
| WO | WO2009141307 | A1 | 11/2009 |

(Continued)

*Primary Examiner* — James O Hansen
(74) *Attorney, Agent, or Firm* — Dority & Manning, P.A.

(57) ABSTRACT

A trigger assembly for a dishwashing appliance defines a vertical direction, a lateral direction, and a transverse direction. The trigger assembly includes a trigger support arm attached to a slide assembly of the dishwashing appliance. The trigger assembly also includes a trigger head attached to the trigger support arm. The trigger head includes a base. The base includes a first leg, a second leg, and an arm. The arm is positioned between the first leg and the second leg approximately along the transverse direction. The trigger head also includes a top attached to the base. The top includes a main body and a tip extended from the main body approximately along the lateral direction. The tip includes an angled leading side and a trailing side spaced apart approximately along the transverse direction.

18 Claims, 11 Drawing Sheets

(56) References Cited

U.S. PATENT DOCUMENTS

| | | | |
|---|---|---|---|
| 9,032,978 | B2 | 5/2015 | Kiechle et al. |
| 9,049,977 | B2 | 6/2015 | Jobst et al. |
| 9,055,851 | B2 | 6/2015 | Johansson |
| 9,107,500 | B2 | 8/2015 | Zimmermann |
| 9,364,089 | B1 | 6/2016 | Chen et al. |
| 9,388,619 | B2 | 7/2016 | Park et al. |
| 9,420,882 | B2 | 8/2016 | Garcia et al. |
| 9,486,077 | B2 | 11/2016 | Brock |
| 9,642,460 | B2 | 5/2017 | Chen et al. |
| 9,968,193 | B1 | 5/2018 | Chen et al. |
| 10,051,963 | B2 | 8/2018 | Azkue et al. |
| 10,053,902 | B1 | 8/2018 | White et al. |
| 10,058,176 | B2 | 8/2018 | Rehage |
| 10,159,398 | B2 | 12/2018 | Wilson et al. |
| 10,292,494 | B1 | 5/2019 | Huang et al. |
| 10,638,838 | B2 | 5/2020 | Stöckli et al. |
| 10,667,608 | B2 | 6/2020 | Rehage et al. |
| 10,736,421 | B2 | 8/2020 | Liao et al. |
| 10,758,043 | B2 | 9/2020 | Pohlmann |
| 11,039,688 | B2 | 6/2021 | Pecar et al. |
| 11,317,783 | B2 | 5/2022 | Scalf et al. |
| 11,395,546 | B2 | 7/2022 | Lee et al. |
| 11,406,186 | B2 | 8/2022 | Chen et al. |
| 11,612,301 | B2 | 3/2023 | Fawaz et al. |
| 2004/0163687 | A1 | 8/2004 | Son et al. |
| 2008/0067905 | A1 | 3/2008 | Guiles et al. |
| 2010/0244642 | A1 | 9/2010 | Radusin et al. |
| 2014/0042884 | A1 | 2/2014 | Domenig et al. |
| 2019/0226259 | A1 | 7/2019 | Gherardi |
| 2020/0115945 | A1 | 4/2020 | Akca et al. |
| 2021/0212461 | A1 | 7/2021 | Stuffel et al. |
| 2022/0202271 | A1 | 6/2022 | Tütek |

FOREIGN PATENT DOCUMENTS

| | | | |
|---|---|---|---|
| WO | WO2012119845 | A1 | 9/2012 |
| WO | WO2015167853 | A1 | 11/2015 |
| WO | WO2018082804 | A2 | 5/2018 |
| WO | WO2019223972 | A1 | 11/2019 |
| WO | WO2020007469 | A1 | 1/2020 |
| WO | WO2022030720 | A1 | 2/2022 |

* cited by examiner

ANGLED LEADING SIDE FOR A TRIGGER HEAD OF A SLIDE ASSEMBLY

FIELD OF THE DISCLOSURE

The present subject matter relates generally to a slide assembly for supporting a rack assembly, such as in a dishwashing appliance.

BACKGROUND OF THE DISCLOSURE

Dishwashing appliances generally include a tub that defines a wash chamber. Rack assemblies can be mounted within the wash chamber of the tub for receipt of articles for washing. Certain dishwashing appliances also include slide assemblies for supporting and enabling movement of the rack assemblies. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

Some existing slide assemblies include a soft close mechanism for dampening movement of the slide assembly. Challenges exist that can result in a decrease in the functionality of the slide assembly. In particular, the soft close mechanism may be unintentionally triggered, e.g., unintentionally or accidentally activated, prior to a retraction operation of the slide assembly. This can result in a false trip failure mode of the soft close mechanism. In other words, the slide assembly may be prevented from fulling retracting.

Accordingly, slide assemblies addressing one or more of the above issues would be useful. In particular, it would be advantageous to provide a slide assembly that is capable of being reset following a false trip failure mode.

BRIEF DESCRIPTION OF THE DISCLOSURE

Aspects and advantages of the invention will be set forth in part in the following description, or may be apparent from the description, or may be learned through practice of the invention.

In one exemplary embodiment, a dishwashing appliance is provided. The dishwashing appliance may define a vertical direction, a lateral direction, and a transverse direction. The dishwashing appliance may include a tub that may define a wash chamber. The dishwashing appliance may also include a rack assembly positioned within the wash chamber. The dishwashing appliance may further include a slide assembly. The slide assembly may include a soft close mechanism in a vertical orientation. The slide assembly may be mounted to the tub. The rack assembly may be slidably mounted to the slide assembly to transition the rack assembly between an extended loading position and a retracted position. The soft close mechanism may include an actuator to dampen movement of the slide assembly. The dishwashing appliance may also include a trigger assembly. The trigger assembly may include a trigger support arm attached to the slide assembly. The trigger assembly may also include a trigger head attached to the trigger support arm. The trigger head may include a base. The base may include a first leg, a second leg, and an arm. The arm may be positioned between the first leg and the second leg approximately along the transverse direction. The trigger head may also include a top attached to the base. The top may include a main body and a tip extended from the main body approximately along the lateral direction. The tip may include an angled leading side and a trailing side spaced apart approximately along the transverse direction.

In another exemplary embodiment, a dishwashing appliance is provided. The dishwashing appliance may define a vertical direction, a lateral direction, and a transverse direction. The dishwashing appliance may include a tub that may define a wash chamber. The dishwashing appliance may also include a rack assembly positioned within the wash chamber. The dishwashing appliance may further include a slide assembly. The slide assembly may include a soft close mechanism in a horizontal orientation. The slide assembly may be mounted to the tub. The rack assembly may be slidably mounted to the slide assembly to transition the rack assembly between an extended loading position and a retracted position. The soft close mechanism may include an actuator to dampen movement of the slide assembly. The dishwashing appliance may also include a trigger assembly. The trigger assembly may include a trigger support arm attached to the slide assembly. The trigger assembly may also include a trigger head attached to the trigger support arm. The trigger head may include a base. The base may include a first leg, a second leg, and an arm. The arm may be positioned between the first leg and the second leg approximately along the transverse direction. The trigger head may also include a top attached to the base. The top may include an angled leading side and a trailing side spaced apart approximately along the transverse direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
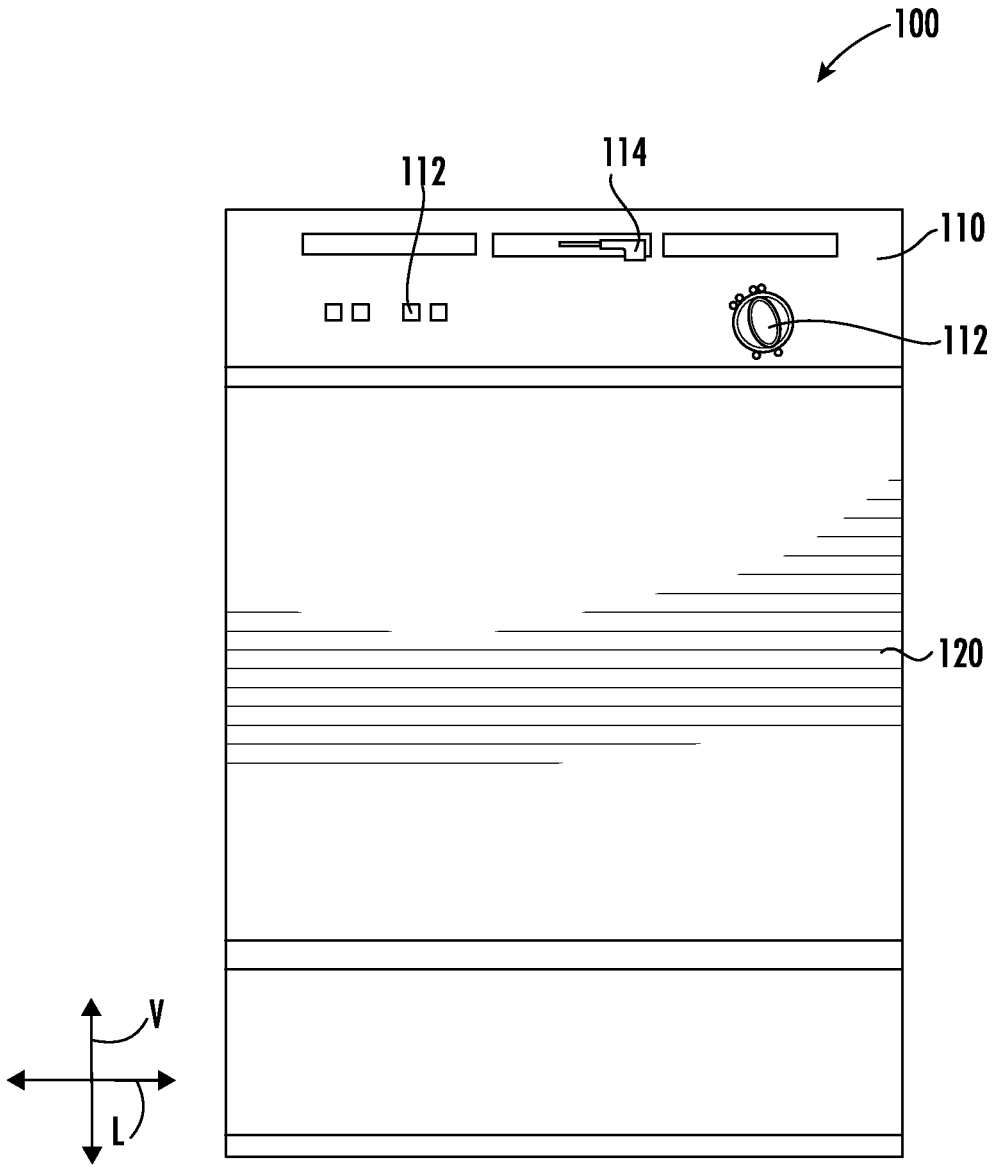
FIG. 1 provides a front elevation view of a dishwashing appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
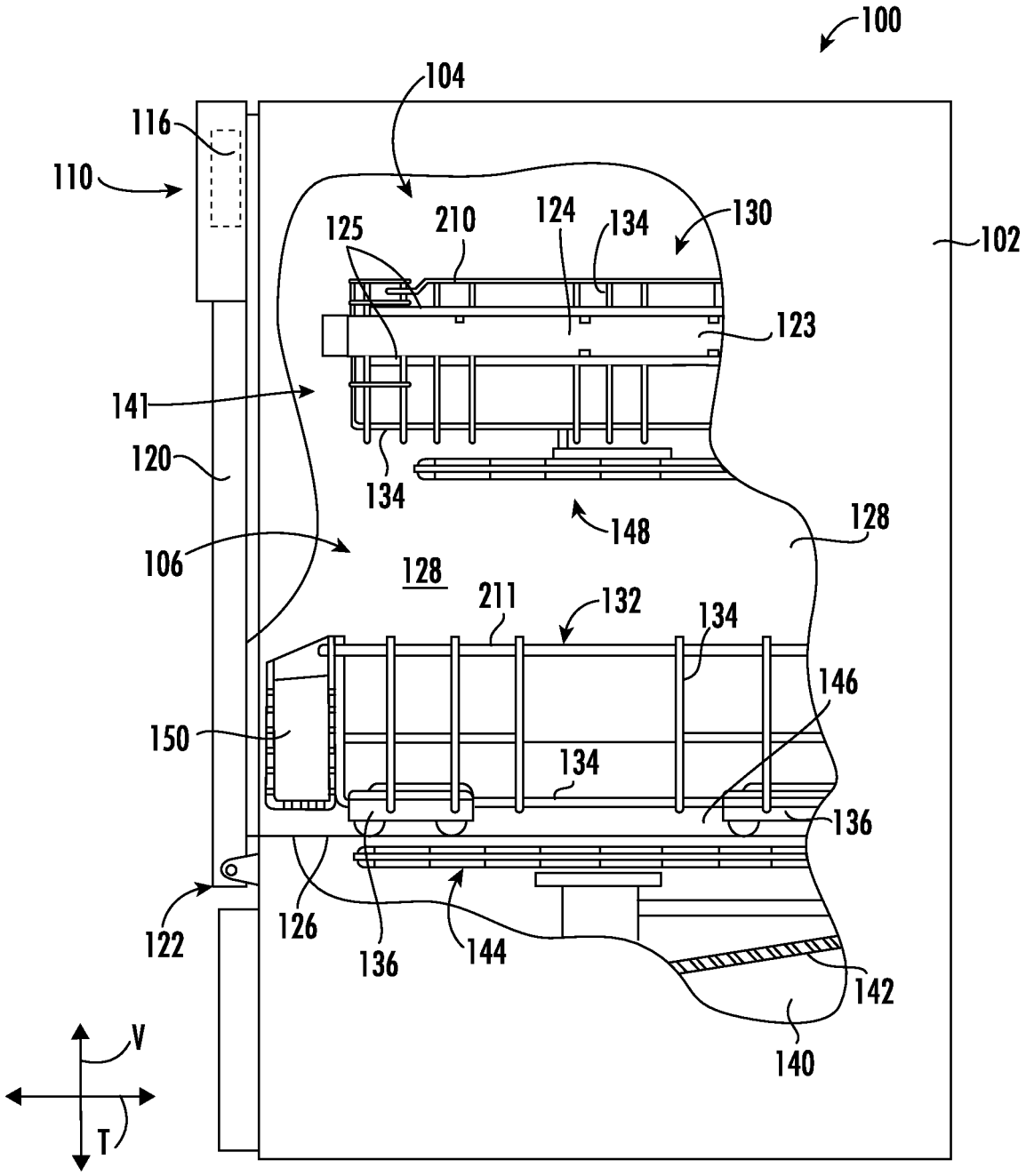
FIG. 2 provides a side, partially cut away view of the exemplary dishwashing appliance of FIG. 1.

Referring now to FIGS. 1 and 2, a dishwashing appliance 100 according to one or more exemplary embodiments of the present subject matter is provided. Specifically, FIG. 1 provides a front elevation view of the dishwashing appliance 100 and FIG. 2 provides a side, partially cut away view of the dishwashing appliance 100 of FIG. 1. As depicted, the dishwashing appliance 100 may define a vertical direction V, a lateral direction L, and a transverse direction T. The vertical direction V, the lateral direction L, and the transverse direction T each being mutually perpendicular with every other, such that an orthogonal direction system is generally defined.

The dishwashing appliance 100 may include a cabinet 102 having a tub 104 therein that defines a wash chamber 106. The tub 104 may include a front opening and a door 120 that may be hinged at a bottom 122 for movement between a normally closed vertical position, e.g., FIGS. 1 and 2, wherein the wash chamber 106 is sealed shut for washing operation, and a horizontal open position (not depicted), wherein the loading and unloading of articles from the dishwashing appliance 100 may occur. In some instances, such as depicted in FIG. 1, the dishwashing appliance 100 may include a latch 114 that may be used to lock and unlock the door 120 such that access to the wash chamber 106 may be permitted or restricted.

In addition, the dishwashing appliance 100 may include one or more rack assemblies, such as an upper rack assembly 130 and a lower rack assembly 132, that may be used to load articles in the dishwashing appliance 100. In some embodiments, the upper rack assembly 130 may be mounted within the dishwashing appliance 100 in an upper region 141 of the wash chamber 106, e.g., above the lower rack assembly 132 with respect to the vertical direction V. The rack assemblies 130, 132 may each be adapted for movement substantially along the transverse direction T between an extended loading position (not shown) in which the respective rack assembly 130, 132 is positioned substantially outside the wash chamber 106 and a retracted position, e.g., FIGS. 1 and 2, in which the respective rack assembly 130, 132 may be located entirely within the wash chamber 106. As illustrated in FIG. 2, the movement of the upper rack assembly 130 may be facilitated by a pair of slide assemblies 124 that may be positioned at opposing lateral sides of the upper rack assembly 130. Additionally, as illustrated in FIG. 2, the movement of the lower rack assembly 132 may be facilitated by a pair of roller assemblies 136 that may be positioned at opposing lateral sides of the lower rack assembly 132.

One of ordinary skill in the art would understand that the pair of slide assemblies 124 and the pair of roller assemblies 136 are provided by way of example only. For instance, in alternative exemplary embodiment, the movement of the upper rack assembly 130 and the lower rack assembly 132 may each be facilitated by a respective pair of slide assemblies such as the pair of slide assemblies 124.

The rack assemblies 130, 132 may each include a dish rack for holding articles therein, e.g., for the cleaning of the articles. For instance, the upper rack assembly 130 may include an upper dish rack 210 and the lower rack assembly 132 may include a lower dish rack 211. The dish racks 210, 211 may each include a plurality of elongated members or rails 134 that may each be extended in the lateral direction L, the transverse direction T, and the vertical direction V. The plurality of rails 134 may be wires, rods, or any other suitable member, which may be fabricated into a lattice structure to form the shape of the respective dish rack 210, 211.

As depicted and described herein, the pair of slide assemblies 124 may include or be provided as a pair of ball bearing slide assemblies 124 that each include an inner rail 123 and outer rail 125. The inner rail 123 may be mounted to, fixed to, or attached to, a lateral tub side wall 128 of the tub 104. The outer rail 125 may be attached to or mounted to a respective lateral side of a corresponding dish rack (e.g., the upper dish rack 210). In some embodiments, the outer rails 125 are slidably mounted onto the respective inner rail 123 such that the outer rails 125 may slide along the respective inner rail 123, e.g., to move the upper rack assembly 130 between the extended loading position and the retracted position. Additionally or alternatively, in some embodiments, the pair of slide assemblies 124 include an intermediate rail 127. As will be further described below, the intermediate rail 127 may include one or more rail caps 222 that each may be attached to a respective transverse end of the intermediate rail 127. Each rail cap 222 may be used to cover the respective transverse end of the intermediate rail 127. For instance, in some embodiments, the intermediate rail 127 may be constructed from a material, for example, metal, that may include exposed edges. Each rail cap 222 may be used to protect a user from the exposed metal edges of the intermediate rail 127.

In addition, lower guides 126 may be positioned in opposing manner of the sides of chamber 106 and provide a ridge or shelf for roller assemblies 136 so as to support and provide movement for the lower rack assembly 132.

Optionally, a silverware basket 150 may be removably attached to the lower rack assembly 132 for placement of silverware, small utensils, and the like, which are too small to be accommodated by the upper rack assembly 130 and the lower rack assembly 132.

Further, the dishwashing appliance 100 may include a lower spray assembly 144 that may be rotatably mounted within a lower region 146 of the wash chamber 106 and above a tub sump portion 142 so as to rotate in relatively close proximity to the lower rack assembly 132, e.g., in closer proximity to the lower rack assembly 132 than to the upper rack assembly 130. In addition, the dishwashing appliance 100 may include a mid-level spray assembly 148 that may be located in the upper region 141 of the wash chamber 106 and may be attached to, or located in close proximity to, the upper rack assembly 130, e.g., the mid-level spray assembly 148 may be in "close proximity" to the upper rack assembly 130 in that the mid-level spray assembly 148 is closer to the upper rack assembly 130 than to the lower rack assembly 132. In some embodiments an upper spray assembly (not shown) may additionally be located above the upper rack assembly 130.

The lower spray assembly 144, the mid-level spray assembly 148, and the upper spray assembly may be fed by a fluid circulation assembly that may be configured for circulating water and wash fluid in the tub 104. Portions of the fluid circulation assembly may be located in a machinery compartment 140 located below the bottom sump portion 142 of the tub 104, as generally recognized in the art. Each spray assembly, e.g., lower spray assembly 144, mid-level spray assembly 148, and upper spray assembly, may include an arrangement of discharge ports or orifices for directing washing liquid onto dishes or other articles located in the upper rack assembly 130 and the lower rack assembly 132, respectively. The arrangement of the discharge ports in at least the lower spray assembly 144 may provide a rotational force by virtue of the washing fluid flowing through the discharge ports. The resultant rotation of the lower spray assembly 144 may provide coverage of dishes and other articles with a washing spray.

The dishwashing appliance 100 may further be equipped with a controller 116 to regulate operation of dishwashing appliance 100. The controller 116 may include a memory (e.g., non-transitive memory) and microprocessor, such as a general or special purpose microprocessor operable to execute programming instructions or micro-control code associated with a cleaning cycle. The memory may represent random access memory such as DRAM or may represent read only memory such as ROM or FLASH. In one embodiment, the processor executes programming instructions stored in memory. The memory may be a separate component from the processor or may be included onboard within the processor.

The controller 116 may be positioned in a variety of locations throughout dishwashing appliance 100. For example, as depicted in FIGS. 1 and 2, the controller 116 may be located within a control panel area 110 of the door 120. In such an embodiment, input/output ("I/O") signals may be routed between the control system and various operational components of dishwashing appliance 100 along wiring harnesses that may be routed through bottom 122 of door 120. In certain embodiments, the control panel area 110 may include input components 112 through which a user may select various operational features and modes and monitor progress of the dishwashing appliance 100. For instance, in some embodiments, input components 112 may be a variety of electrical, mechanical, or electro-mechanical input devices including rotary dials (e.g., FIG. 1), push buttons (e.g., FIG. 1), or touch pads, etc. In some embodiments, the control panel area 110 may include a display component, such as a digital or analog display device designed to provide operational feedback to a user. The input components 112 may be in communication with controller 116 via one or more signal lines or shared communication busses.

It should be appreciated that the present subject matter is not limited to any particular style, model, or configuration of dishwashing appliance. Thus, the exemplary embodiment depicted in FIGS. 1 and 2 are for illustrative purposes only. For example, different locations may be provided for the input components 112, different configurations may be provided for the upper rack assembly 130 and the lower rack assembly 132, and other differences may be applied as well.

Only a single slide assembly 124 (or elements thereof) is illustrated in FIGS. 3 through 7 and described in the following corresponding paragraphs for the sake of clarity and simplicity. Those of ordinary skill in the art will understand that the exemplary slide assembly 124 shown and described in FIGS. 3 through 7 may be one of a pair. For example, a second slide assembly may be provided opposite the illustrated slide assembly 124. As would be understood, such a second slide assembly may be provided on an opposite tub side wall 128 (e.g., at the same vertical height as the first slide assembly 124). Additionally or alternatively, the second slide assembly may be a substantial duplicate of the illustrated and described slide assembly 124, such as a mirrored version of the illustrated and described slide assembly 124.

Figure 3:
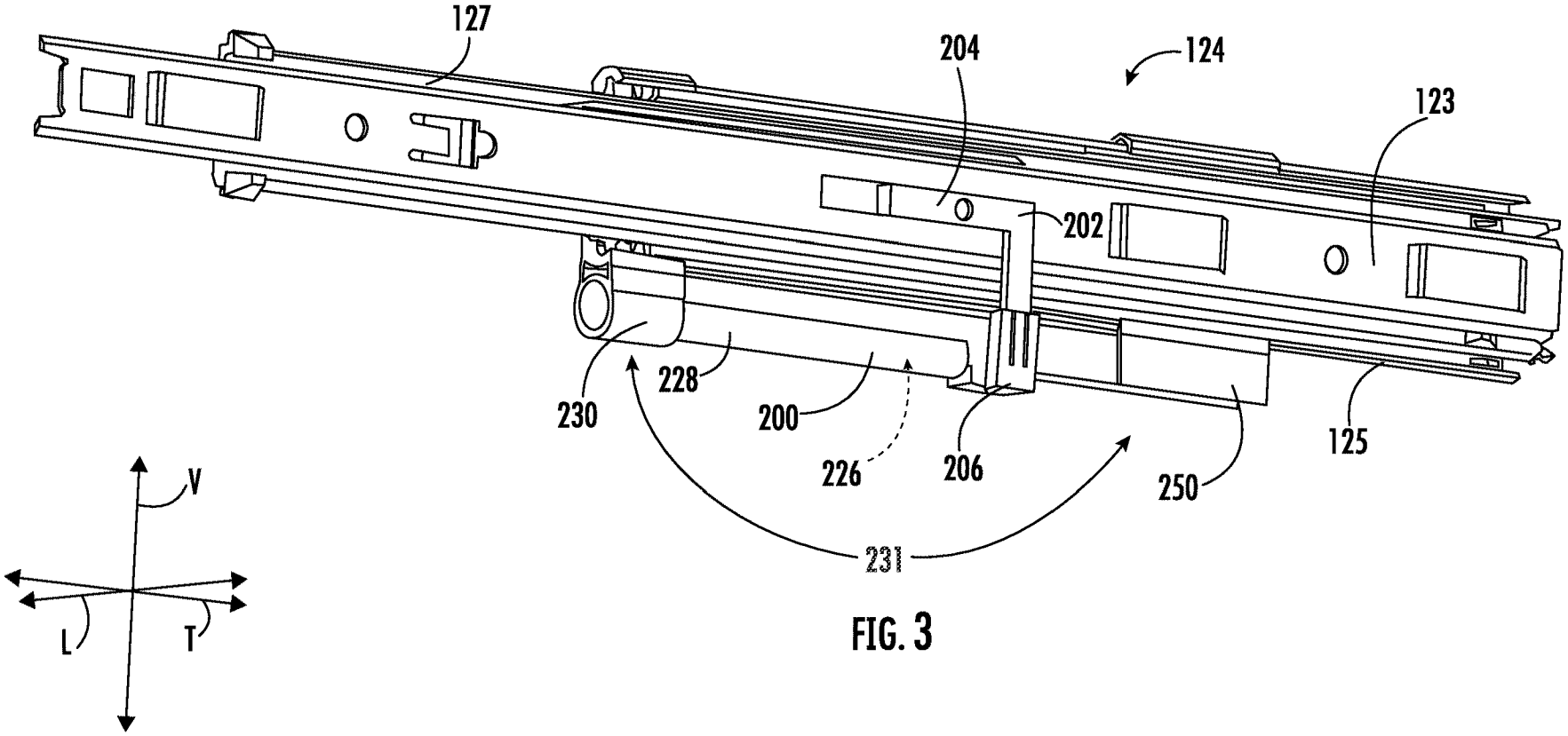
FIG. 3 provides a perspective view of a slide assembly that may be incorporated into a dishwashing appliance, such as the dishwashing appliance of FIG. 1, according to one or more exemplary embodiments of the present subject matter.
Figure 4:
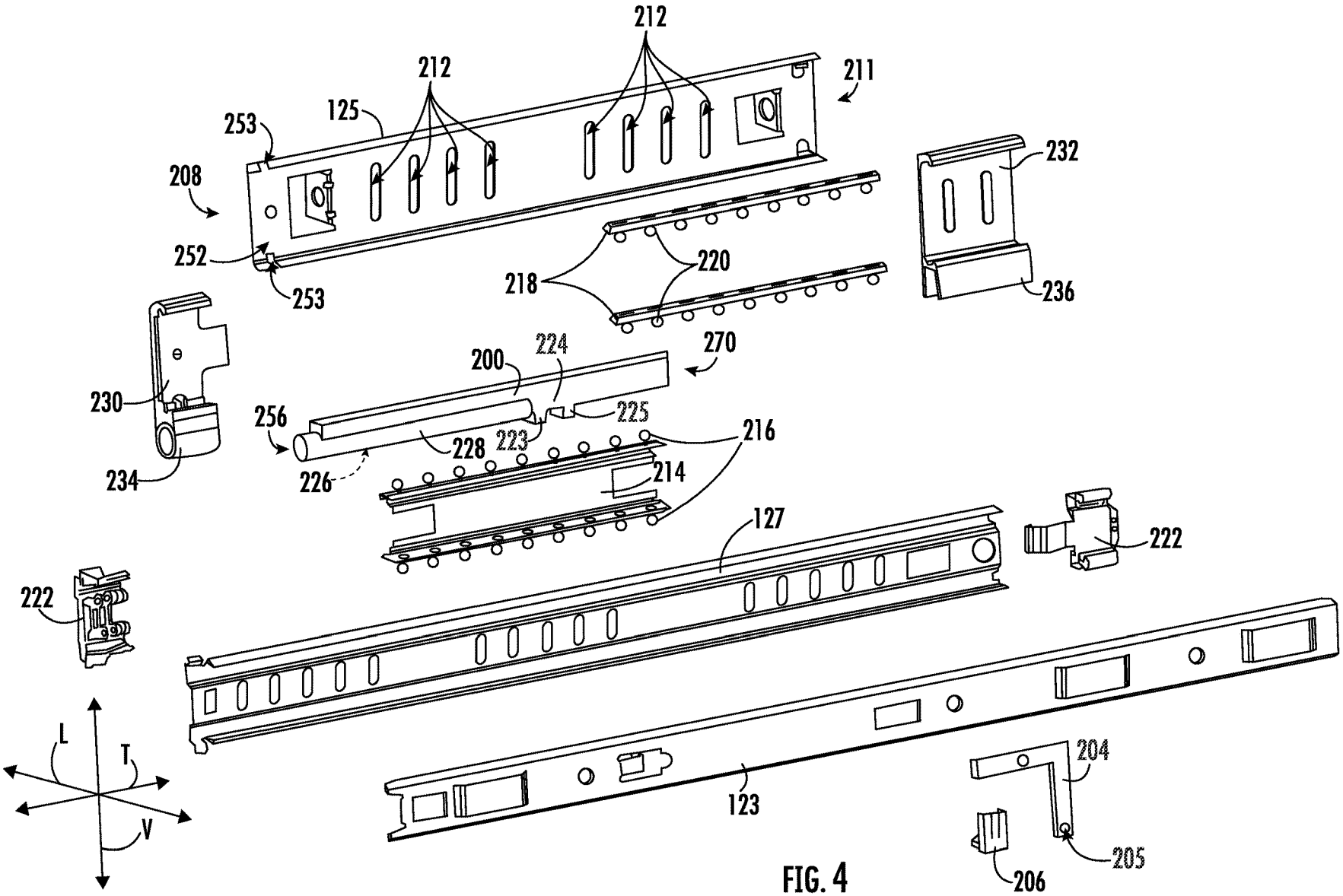
FIG. 4 provides an exploded view of the exemplary slide assembly of FIG. 3.

Referring now to FIGS. 3 and 4, an exemplary slide assembly 124 is provided according to one or more exemplary embodiments of the present subject matter. Specifically, FIG. 3 depicts a perspective view of the slide assembly 124 and FIG. 4 depicts an exploded view of the slide assembly 124. Moreover, the vertical direction V, the lateral direction L, and the transverse direction T described herein, with respect to the various elements of the slide assembly 124 are, except as otherwise indicated, generally understood to correspond to the position of those elements when slide assembly 124 may be attached within wash chamber 106. For example, slide assembly 124 may be attached to the side wall 128 (e.g., via one or more suitable fasteners, screws, bolts, rivets, welds, adhesives, or molded joints). When assembled, slide assembly 124 may extend substantially in or along the transverse direction T. In use, slide assembly 124 may be able to transition, or slide, a dish rack, such as the upper dish rack 210, substantially in or along the transverse direction T.

In some embodiments, the slide assembly 124 is mounted within the wash chamber 106, for instance, to one of the side walls 128 of the tub 104. In addition, the slide assembly 124 may be provided to transition the rack assembly, for example, the upper rack assembly 130 (FIG. 2), between an extended loading position (not pictured) and a retracted position (e.g., FIG. 3). As will be described in greater detail below, the slide assembly 124 may include an inner rail 123, an outer rail 125, and a soft close mechanism 200. Additionally or alternatively, slide assembly 124 may include a trigger assembly 202 that includes a trigger support arm 204 and a trigger head 206. The trigger assembly 202 may be configured to interact with the soft close mechanism 200. For instance, the trigger assembly 202 may "trigger" or activate the soft close mechanism 200 by interacting with a saddle (e.g., as will be described in more detail below) of the soft close mechanism 200. Further additionally or alternatively, slide assembly 124 may include a mount assembly 231. In some embodiments, the inner rail 123 may be attached to the tub 104, and more particularly, may be attached directly to one of the side walls 128 of the tub 104. For instance, the inner rail 123 may be attached to the tub side wall 128 via any suitable fastener. For example, the inner rail 123 may be attached (e.g., directly) to the tub side wall 128 via rivets, bolts, screws, welds, etc.

In some embodiments, the outer rail 125 extends between a first end 208 and a second end 213 approximately along the transverse direction T and may be slidably attached to the inner rail 123. When assembled, the slide assembly 124 may, thus, be capable of transitioning between the extended loading position and the retracted position. Additionally, in some embodiments, the outer rail 125 may include a plurality of slots 212 defined therethrough. Each slot of the plurality of slots 212 may extend approximately along the vertical direction V. Additionally, each slot of the plurality of slots 212 may be spaced apart approximately along the transverse direction T from adjacent slot(s) (e.g., in mutual parallel with each other). For instance, the plurality of slots 212 may be spaced apart between the first end 208 of the outer rail 125 and the second end 213 of the outer rail 125.

In some embodiments, for example, as illustrated in FIGS. 3 and 4, the slide assembly 124 also includes an intermediate rail 127. In some such embodiments, the outer rail 125 is slidably attached (e.g., directly) to the intermediate rail 127, which is slidably attached (e.g., directly) to the inner rail 123. In addition, the slide assembly 124 may include an inner cage 214 that may include a first set of ball bearings 216 and an outer cage 218. The outer cage 218 may include a second set of ball bearings 220.

When assembled, the inner cage 214 may be positioned between the intermediate rail 127 and the inner rail 123. The first set of ball bearings 216 may facilitate the movement of the intermediate rail 127 relative to the inner rail 123. In addition, the outer cage 218 may be positioned between the intermediate rail 127 and the outer rail 125. The second set of ball bearings 220 may facilitate the movement of the outer rail 125 relative to the intermediate rail 127. In this regard, during movement of the slide assembly 124, for example, when moving the slide assembly 124 between the extended loading position and the retracted position, the intermediate rail 127 may be capable of sliding along the inner rail 123 approximately along or parallel to the transverse direction T. Additionally or alternatively, the outer rail 125 may be capable of sliding along the intermediate rail 127 approximately along or parallel to the transverse direction T.

In some embodiments, the slide assembly 124 includes a soft close mechanism 200 to dampen movement of the slide assembly 124. More particularly, the soft close mechanism 200 may be provided to control, dampen, or quiet the movement of components, for instance, the intermediate rail 127 or the outer rail 125, during a retraction operation of the slide assembly 124. A retraction operation of the slide assembly 124 may be an operation of the slide assembly 124 wherein the slide assembly 124 may be retracted from the extended loading position to the retracted position such as when a user of the dishwashing appliance 100 may retract a rack assembly, such as the upper rack assembly 130.

Generally, the soft close mechanism 200 may be provided as any suitable soft close mechanism. In some embodiments, the soft close mechanism 200 is extended between a front end 256 and a rear end 270 (e.g., approximately along the transverse direction T or otherwise along the predefined direction of sliding movement). In some embodiments, the soft close mechanism 200 includes a saddle 224 and an actuator 226, for example, a spring, a damper, or a combination thereof, positioned within an actuator housing 228. The saddle 224 may include a front edge 223 and a rear edge 225 that may be spaced apart approximately along the transverse direction T.

Further, the saddle 224 may be coupled to the actuator 226 and may be configured as an intermediary component between the trigger assembly 202 and the actuator 226. For instance, during a retraction operation of the slide assembly 124, the trigger head 206 may interact with the saddle 224 to engage the actuator 226. The actuator 226 may be configured to dampen the movement of the outer rail 125 relative to the inner rail 123 such that a "soft close" of the slide assembly 124 may be achieved. Specifically, in some instances, the actuator 226 may include a spring and a damper. For example, during a retraction operation of the slide assembly 124, the spring, which may have been held in tension, may release potential energy (e.g., elastic potential energy) and the damper may create resistance for the spring during the retraction operation to slow down the movement of the slide assembly such that the "soft close" of the slide assembly 124 may be achieved.

Further, in some embodiments, the slide assembly 124 includes a mount assembly 231 that may be utilized to mount the soft close mechanism 200 to the outer rail 125. As illustrated in FIGS. 3 and 4, the mount assembly 231 may include an end cap 230 attached to the first end 208 of the outer rail 125, a second mount 232 attached to the outer rail 125, a first mount body 234, and a second mount body 236. Particularly, the soft close mechanism 200 may be mounted to the first mount body 234 and the second mount body 236 such that the soft close mechanism 200 is mounted to the outer rail 125. As used herein "mounted to" with regards to the soft close mechanism 200, the first mount body 234, and the second mount body 236 may refer to the soft close mechanism 200, or a portion thereof, being securely attached to or fixed to, such as or within, a portion of the first mount body 234, the second mount body 236, or a combination thereof.

It should be appreciated that the general orientation of the slide assembly 124 and the components thereof are provided by way of example only. For instance, in alternative exemplary embodiments, the slide assembly 124 may be oriented such that the soft close mechanism 200 and the trigger head 206 may be positioned atop of the slide assembly 124 approximately along the vertical direction V.

Figure 5:
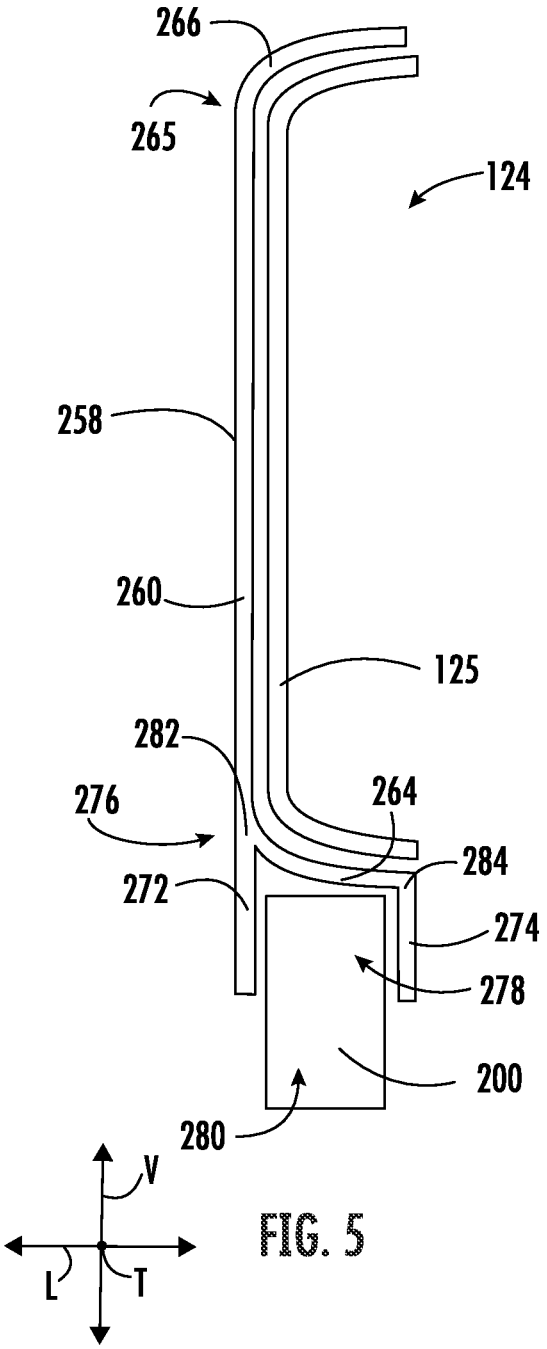
FIG. 5 provides a simplified cross-sectional view of the exemplary slide assembly of FIG. 3.

Referring now to FIG. 5, a simplified cross-sectional view of the slide assembly 124 according to one or more exemplary embodiments of the present subject matter is provided. Specifically, FIG. 5 depicts a simplified cross-sectional view of the slide assembly 124 in a vertical orientation. In some embodiments, the second mount body 236 may include a first wall 272 and a second wall 274. For instance, the first wall 272 may extend from or be in line with, the first edge 276 of the mount wall 260 of the second mount 232. In this regard, the first wall 272 may be extended approximately along the vertical direction V from the mount wall 260.

In some embodiments, the first wall 272 and the second wall 274 define the housing cavity 268 that the soft close mechanism 200 may be mounted within. For instance, in some embodiments, the soft close mechanism 200 may include a first portion 278 and a second portion 280. The first portion 278 of the soft close mechanism 200 may be mounted entirely within the housing cavity 268 and the second portion 280 may be positioned outside of the housing cavity 268. In this regard, the first portion 278 of the soft close mechanism 200 may be the only portion of the soft close mechanism 200 that is mounted within the second mount body 236.

Particularly, the first portion 278 of the soft close mechanism 200 may correspond to a portion of the soft close mechanism 200 that may be used to mount or attach the soft close mechanism 200 to the first mount body 234, the second mount body 236, or a combination thereof. Further, the second portion 280 of the soft close mechanism 200 may correspond to the actuation components of the soft close mechanism 200, for example, the saddle 224 or the actuator 226, that may interact with, or may be influenced by, the trigger assembly 202 during operation of the slide assembly 124, for instance, during a retraction operation of the slide assembly 124.

As illustrated in FIG. 5, the second mount body 236 may be positioned in a vertical orientation. In the vertical orientation, the second mount body 236 and components thereof extend generally along the vertical direction V. In this regard, the second mount body 236 may define an opening, e.g., the housing cavity 268, that faces toward or along the vertical direction V. Further, the orientation of the second mount body 236 may determine the orientation of the soft close mechanism 200. For instance, when the second mount body 236 is in the vertical orientation, the soft close mechanism 200 may be mounted within the second mount body 236 in a vertical orientation, e.g., the soft close mechanism 200 may also extend generally along the vertical direction V.

For instance, in the vertical orientation, the first portion 278 and the second portion 280 of the soft close mechanism 200 are positioned adjacent to each other approximately along the vertical direction V. In other words, the first portion 278 and the second portion 280 of the soft close mechanism 200 may be stacked atop one another such that the soft close mechanism 200 is orientated vertically. For example, as illustrated in FIG. 5, the second portion 280 of the soft close mechanism 200 may be positioned atop the first portion 278 of the soft close mechanism 200 approximately along the vertical direction V.

In some embodiments, the second lip is attached to the second edge 265 of the mount wall 260. The first lip 264 of the main body 258 may include a proximal end 282 that may be attached to the first edge 276 of the mount wall 260. In addition, the first lip 264 of the main body 258 may include a distal end 284. Further, in the vertical orientation, the second wall 274 of the second mount body 236 may be extended from the distal end 284 of the first lip 264 approximately along the vertical direction V. For instance, the second wall 274 of the second mount body 236 may be extended such that the second wall 274 is approximately parallel to the first wall 272. In this regard, the second mount body 236 and the housing cavity 268 defined by the second mount body 236 may be in the vertical orientation.

Figure 6:
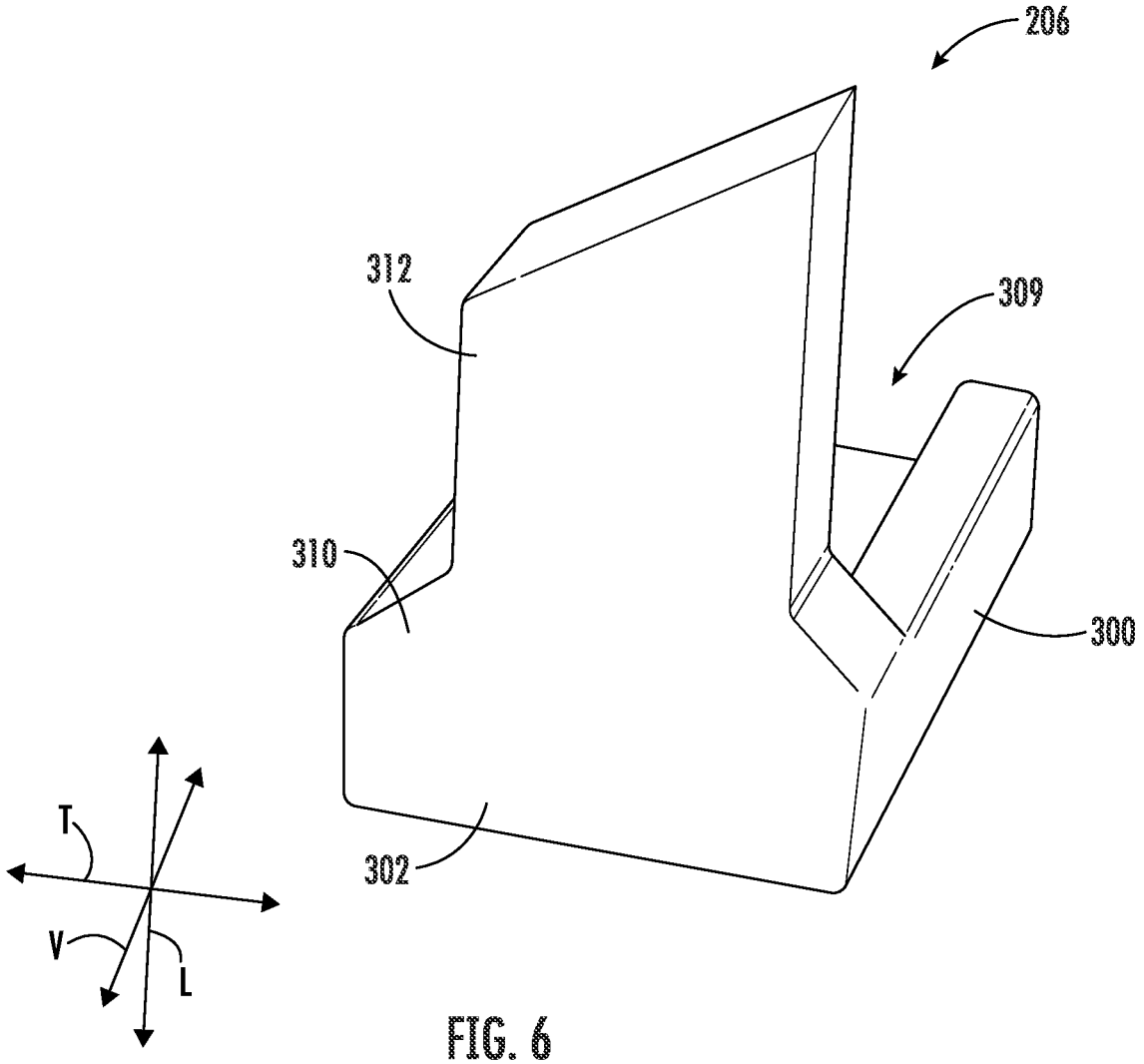
FIG. 6 provides a perspective view of a trigger head of the exemplary slide assembly of FIG. 3.
Figure 7:
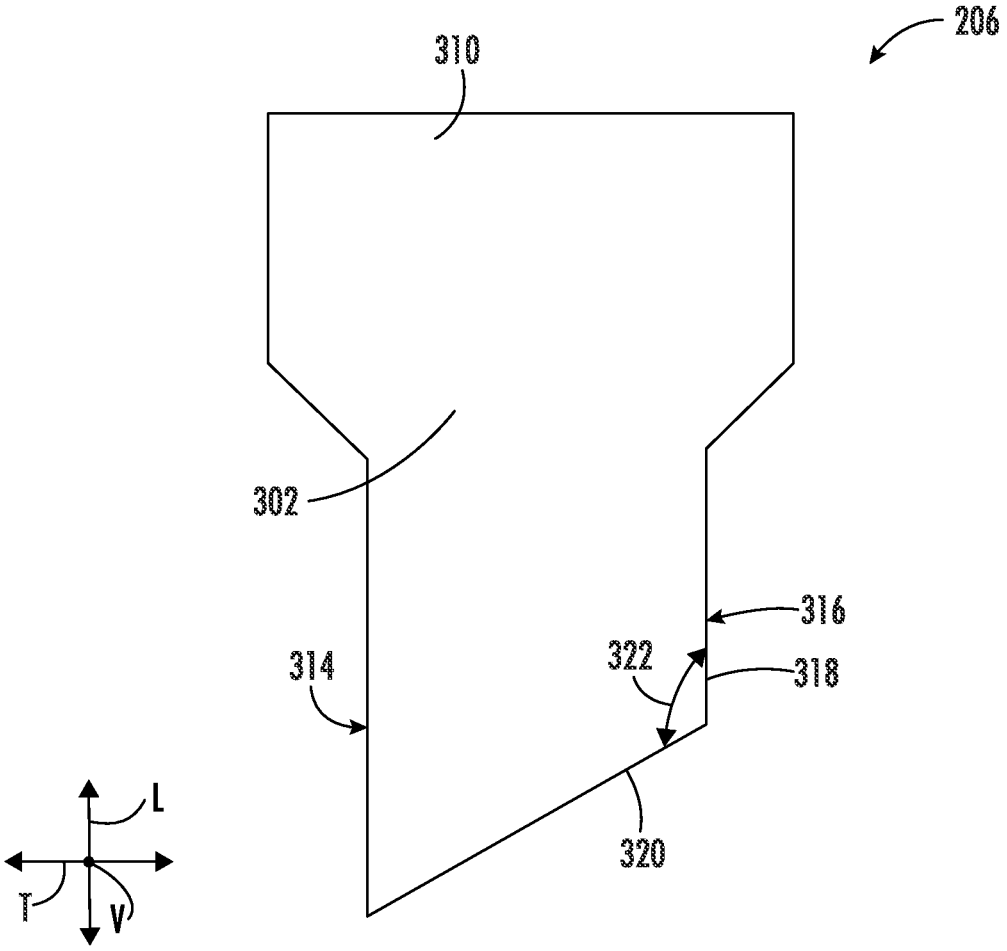
FIG. 7 provides a top view of the exemplary trigger head of FIG. 6.
Figure 8:
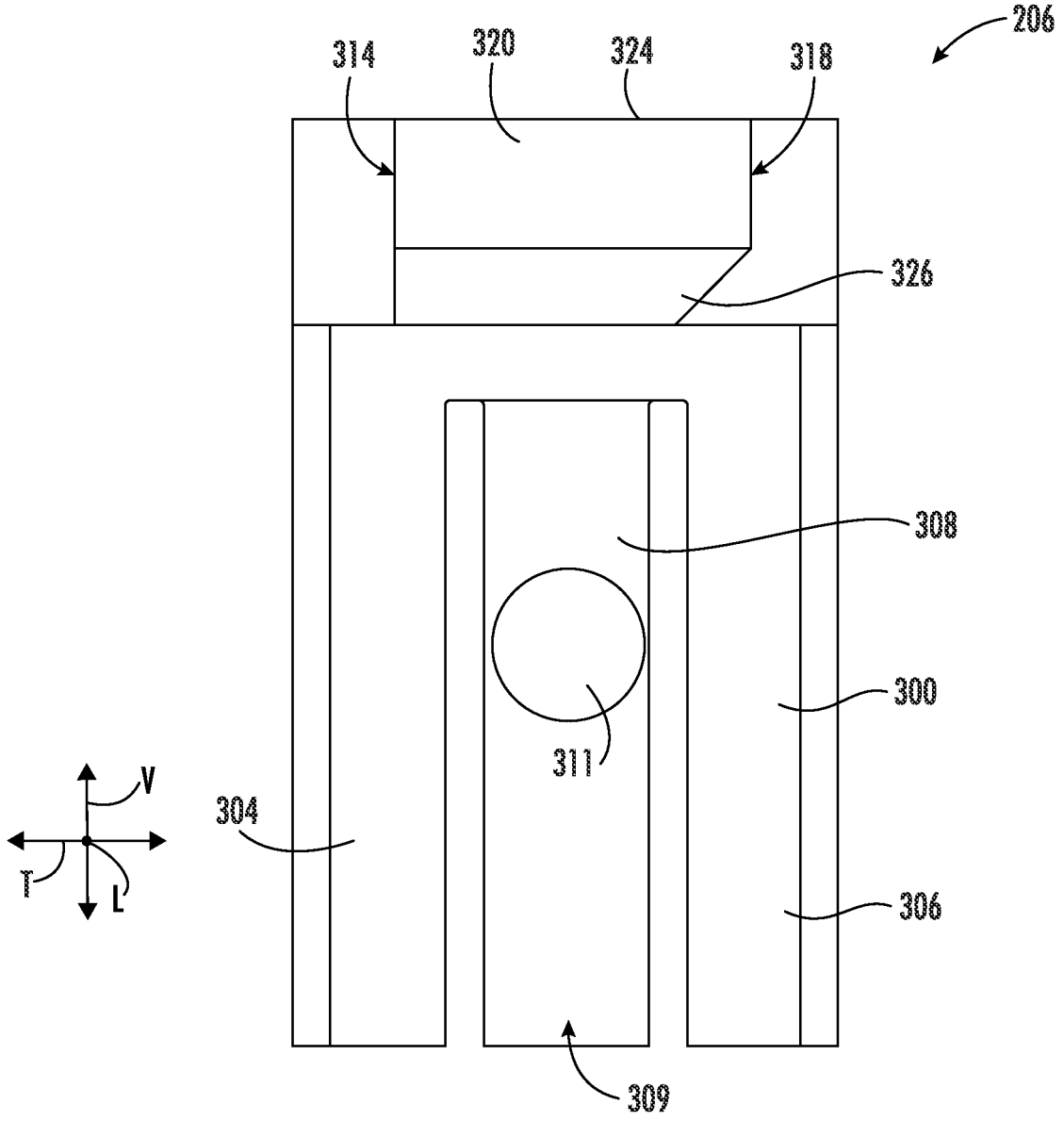
FIG. 8 provides a front view of the exemplary trigger head of FIG. 6.
Figure 9:
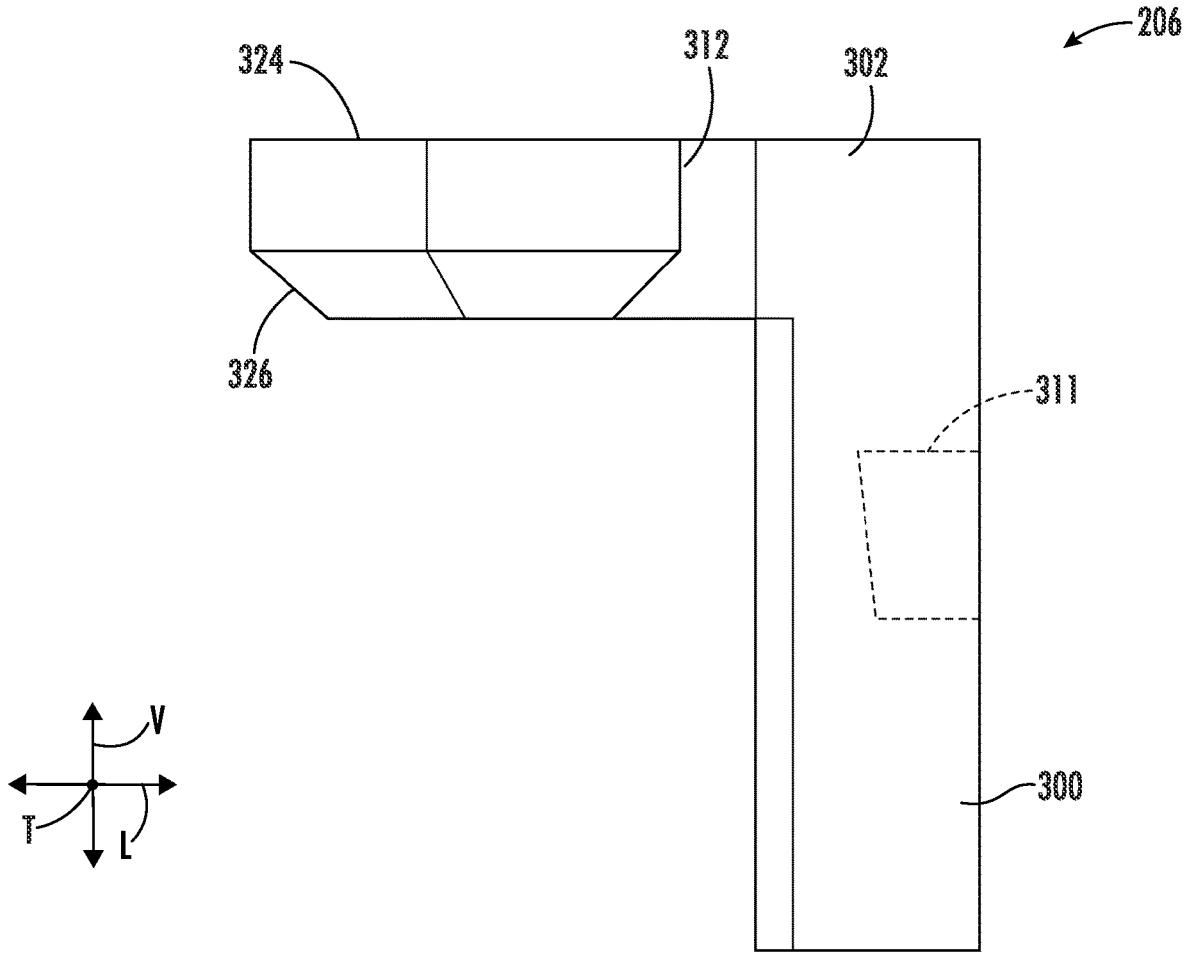
FIG. 9 provides a side view of the exemplary trigger head of FIG. 6.

Referring now to FIGS. 6 through 9, exemplary embodiments of the trigger head 206 of the exemplary slide assembly 124 are provided according to one or more exemplary aspects of the present subject matter. Specifically, FIG. 6 illustrates a perspective view of the trigger head 206, FIG. 7 illustrates a top view of the trigger head 206, FIG. 8 illustrates a front view of the trigger head 206, and FIG. 9 illustrates a side view of the trigger head 206. As will be appreciated, the trigger head 206 may be configured to engage with a soft close mechanism (e.g., in a vertical orientation). For instance, the trigger head 206 may be configured to engage with the soft close mechanism 200 in the vertical orientation as illustrated in FIG. 5.

In some embodiments, the trigger head 206 generally includes a base 300 and a top 302. The base 300 may generally be configured to attach the trigger head 206 to the trigger support arm 204. For instance, the base 300 may define a slot 309 that the trigger support arm 204 may be attached within. Particularly, a first leg 304, a second leg 306, and an arm 308 of the base 300 may define the slot 309. In some embodiments, the first leg 304, the second leg 306, and the arm 308 each extend approximately along the vertical direction V. Further, the first leg 304 and the second leg 306 may be spaced apart approximately along the transverse direction T. For example, the first leg 304 may be positioned at a first transverse side of the base 300 and the second leg may be positioned at a second transverse side of the base 300. In addition, the arm 308 may be positioned between the first leg 304 and the second leg 306 (e.g., approximately along the transverse direction T). The arm 308 may be positioned at a lateral end of the base 300. Thus, the first leg 304, the second leg 306, and the arm 308 may generally define the slot 309 therebetween.

Further, in some embodiments, the arm 308 includes a pin 311 that may be extended approximately along the lateral direction L. The pin 311 may be inserted into a hole 205 (see, e.g., FIG. 4) defined through the trigger support arm 204. Thus, the trigger head 206 may be attached, e.g., secured, to the trigger support arm 204 within the slot 309.

Additionally, the top 302 may be attached (e.g., directly, or indirectly) to the base 300. For instance, in some embodiments, the base 300 and the top 302 are a monolithic piece that is formed of any suitable material, for example, a rigid polymer material. The top 302 may generally be configured to interact with the soft close mechanism 200. Additionally, the top 302 may include a main body 310 and a tip 312. The tip 312 may be extended from the main body 310 approximately along the lateral direction L. The extensions of the tip 312 may allow the trigger head 206 to engage with, e.g., contact, a soft close mechanism 200 in a vertical orientation. For instance, the extension of the tip 312 may allow the trigger head 206 to engage with a saddle, such as the saddle 224 of the soft close mechanism 200 when the soft close mechanism 200 is in a vertical orientation.

In some embodiments, the top 302, and more particularly, the tip 312, includes a trailing side 314 and an angled leading side 316. The trailing side 314 and the angled leading side 316 may be spaced, at least in part, approximately along the transverse direction T. The angled leading side 316 may include a first portion 318 and a second portion 320. The first portion 318 and the second portion 320 may define a predetermined angle 322 therebetween. In some embodiments, the first portion 318 is extended along or approximately parallel to the lateral direction L and the second portion 320 is extended from the first portion 318 at the predetermined angle 322. The predetermined angle 322 may be any suitable angle (e.g., greater than 0°) that may form the angled leading side 316. For instance, in some embodiments (e.g., as illustrated in FIGS. 6 through 9), the predetermined angle 322 is an obtuse angle (e.g., an angle which is greater than ninety degrees (90°) and less than one hundred eighty degrees (180°)).

Figure 10:
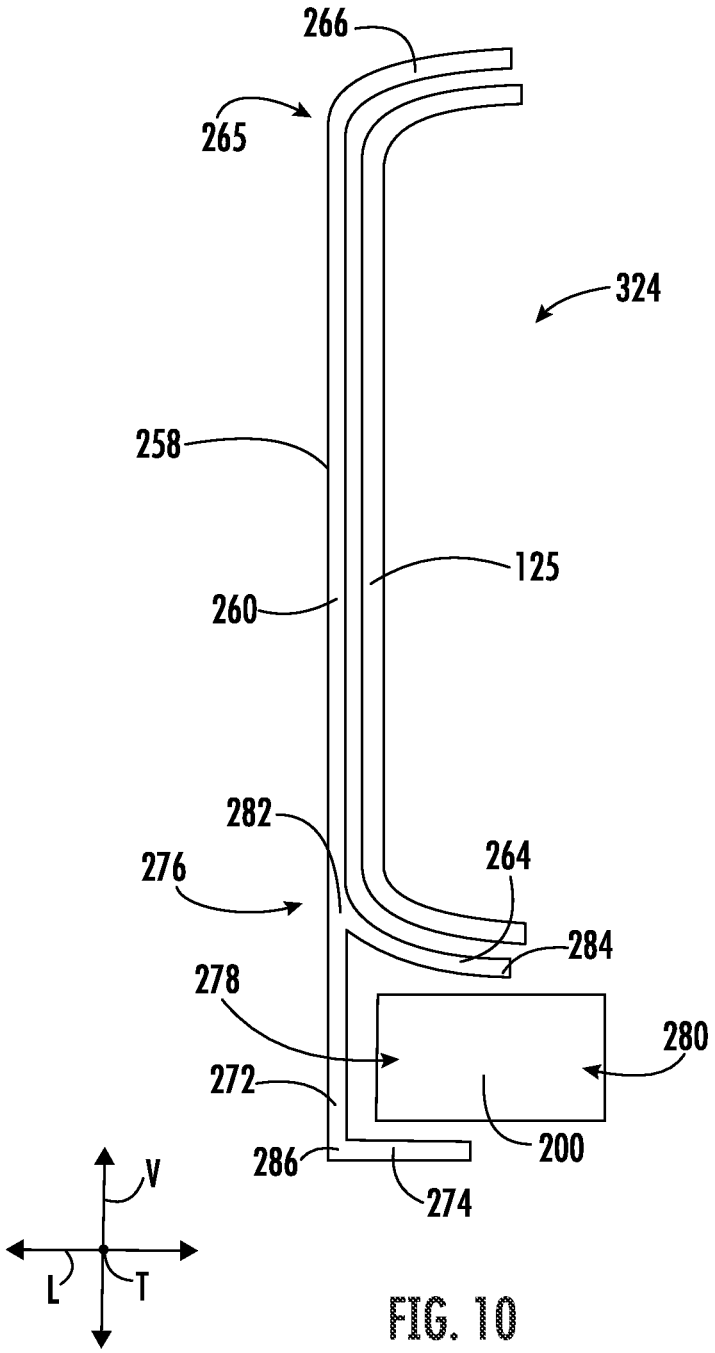
FIG. 10 provides a simplified cross-sectional view of an alternative slide assembly according to one or more exemplary embodiments of the present subject matter.

The second portion 320 of the angled leading side 316 may include a first leading edge 324 and a second leading edge 326. For instance, as illustrated in FIGS. 9 and 10, the first leading edge 324 and the second leading edge 326 may be spaced apart approximately along the vertical direction V. In some embodiments, the second leading edge 326 is chamfered. For instance, the second leading edge 326 may be angled or beveled such that a sloping surface is formed. Thus, in some embodiments, the second leading edge 326 is referred to as a chamfered leading edge 326.

The angled leading side 316 of the trigger head 206 may advantageously help facilitate resetting of the slide assembly 124 following a false trip failure mode of the slide assembly 124, and more particularly, the soft close mechanism 200. A "false trip failure mode" may refer to a failure mode of the soft close mechanism 200 wherein the actuator 226 of the soft close mechanism 200 may unintentionally be triggered, e.g., activated. For instance, the soft close mechanism 200 may be triggered, e.g., activated, by a source other than the trigger head 206. For example, articles within the rack assembly or a user may unintentionally strike, and thereby, trigger the soft close mechanism 200. This unintentionally triggering of the soft close mechanism 200 may prevent the slide assembly 124 from completely closing, e.g., being fully retracted.

In order to reset the slide assembly 124 following a false trip failure mode, the slide assembly 124 may be manually closed, e.g., manually moved or pushed toward the retracted position. In this regard, the angled leading side 316 of the trigger head 206 may engage, or contact, the rear edge 225 of the saddle 224. Specifically, the sloped surfaces created by the angled leading side 316, e.g., sloped surface created by the first portion 318 and the second portion 320 and the sloped surface of the chamfered second leading edge 326, may deflect the saddle 224 when the trigger head 206 is engaged with, or has contacted, the rear edge 225 of the saddle 224. Thus, the angled leading side 316 may allow the slide assembly to be reset, e.g., returned to a position wherein the trigger head 206 is positioned within the saddle 224, following a false trip failure mode of the soft close mechanism 200.

Referring now to FIG. 10, a simplified cross-sectional view of a slide assembly 424 in accordance with another exemplary aspect of the present subject matter may be provided. The exemplary slide assembly 424 of FIG. 10 may be configured in substantially the same manner as the exemplary slide assembly 124 of FIG. 5, and accordingly, the same or similar numbers may refer to the same or similar parts.

For example, the exemplary slide assembly 424 of FIG. 10 generally includes a mount assembly 231 that may include a second mount 232 attached to an outer rail 125. The second mount 232 may include a main body 258 that may include a mount wall 260, a first lip 264 attached to a first edge of the mount wall 260, and a second lip 266 attached to a second edge of the mount wall 260. The mount assembly 231 may also include a first wall 272 that may include a proximal end 282 attached to the first edge 276 of the mount wall 260 and a distal end 284. However, for the embodiment of FIG. 10, the second mount body 236 may be in a horizontal orientation. Particularly, the second wall 274 of the second mount body 236 may be extended from the distal end 284 of the first wall 272 approximately along the lateral direction L, for instance, such that the second wall 274 is positioned approximately perpendicularly to the first wall 272. In this regard, the horizontal orientation of the second mount body 236 may be formed.

As illustrated in FIG. 10, the soft close mechanism 200 may be mounted within the second mount body 236 in a horizontal orientation. In the horizontal orientation, the second mount body 236 and components thereof may extend generally along the lateral direction L. In this regard, the second mount body 236 may define an opening, e.g., the housing cavity 268, that faces toward or along the lateral direction L. Further, the orientation of the second mount body 236 may determine the orientation of the soft close mechanism 200. For instance, when the second mount body 236 is in a horizontal orientation, the soft close mechanism 200 may be mounted within the second mount body 236 in a horizontal orientation, e.g., the soft close mechanism 200 may also extend generally along the lateral direction L.

For instance, in the horizontal orientation the first portion 278 and the second portion 280 of the soft close mechanism 200 are positioned adjacent to each other approximately along the lateral direction L. In other words, the first portion 278 and the second portion 280 of the soft close mechanism 200 may be positioned side by side such that the soft close mechanism 200 is orientated horizontally. The horizontal orientation of the second mount body 236 may be utilized to accommodate different styles and orientations of triggers, such as the trigger assembly 202, and more particularly trigger heads, such as the trigger head 206.

Figure 11:
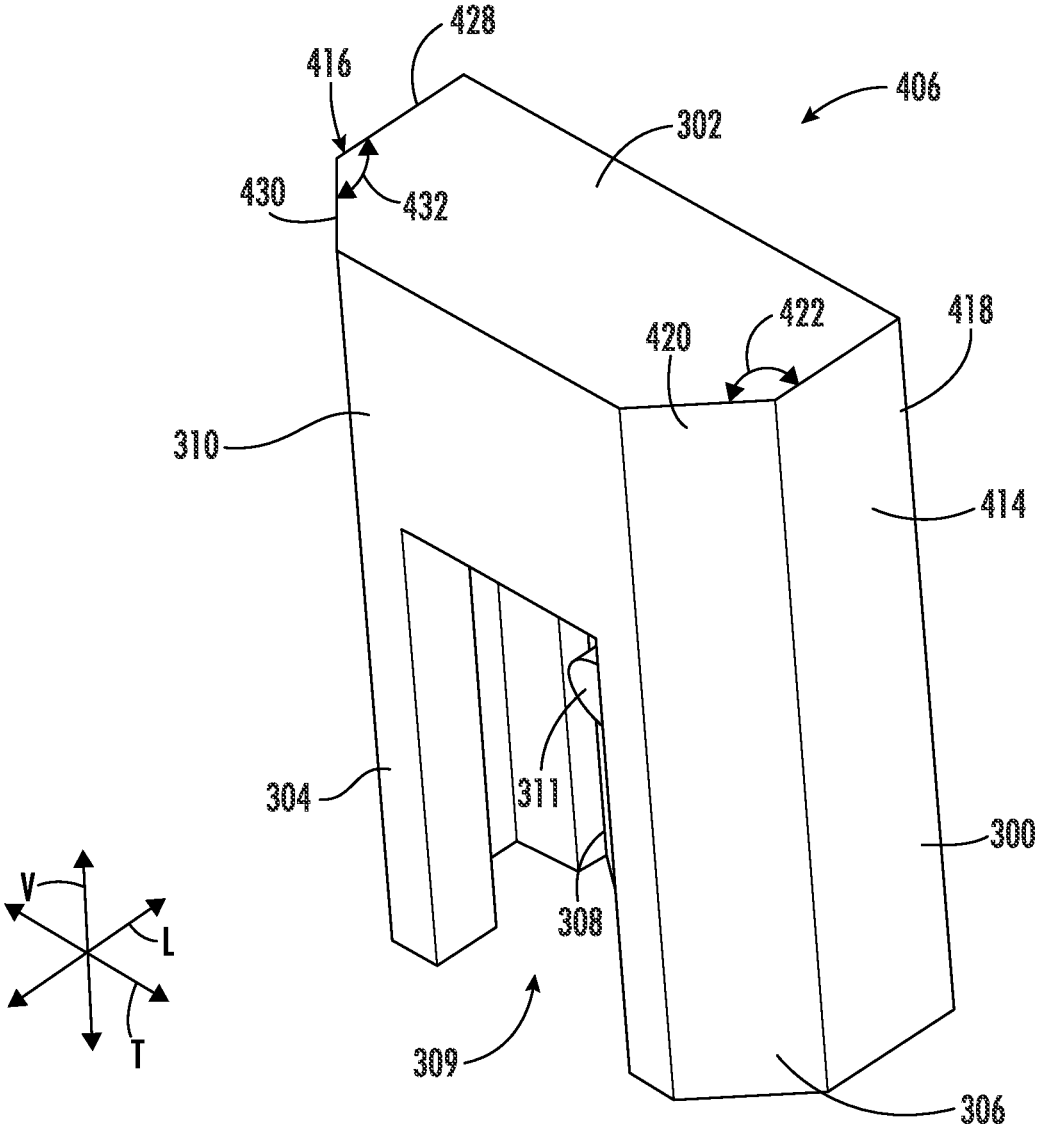
FIG. 11 provides a perspective view of an alternative trigger head that may be incorporated into a slide assembly, such as the slide assembly of FIG. 10, according to one or more exemplary embodiments of the present subject matter.

Referring now to FIG. 11, a perspective view of a trigger head 406 in accordance with another exemplary aspect of the present disclosure is provided. The exemplary trigger head 406 may be configured in substantially the same manner as the exemplary trigger head 206 of FIGS. 6 through 9, and accordingly, the same or similar numbers may refer to the same or similar parts.

For example, the exemplary trigger head 406 of FIG. 11 generally includes a base 300 and a top 302. The base 300 may generally be configured to attach the trigger head 206 to the trigger support arm 204. For instance, the base 300 may define a slot 309 that the trigger support arm 204 may be attached within. Particularly, a first leg 304, a second leg 306, and an arm 308 of the base 300 may define the slot 309. In some embodiments, the first leg 304, the second leg 306, and the arm 308 each extend approximately along the vertical direction V. Further, the first leg 304 and the second leg 306 may be spaced apart approximately along the transverse direction T. For example, the first leg 304 may be positioned at a first transverse side of the base 300 and the second leg may be positioned at a second transverse side of the base 300. In addition, the arm 308 may be positioned between the first leg 304 and the second leg 306 (e.g., approximately along the transverse direction T). The arm 308 may be positioned at a lateral end of the base 300. Thus, the first leg 304, the second leg 306, and the arm 308 may generally define the slot 309 therebetween.

Further, in some embodiments, the arm 308 includes a pin 311 that may be extended approximately along the lateral direction L. The pin 311 may be inserted into a hole 205 (see, e.g., FIG. 4) defined through the trigger support arm 204.

Thus, the trigger head 206 may be attached, e.g., secured, to the trigger support arm 204 within the slot 309.

Additionally, the top 302 may be attached (e.g., directly or indirectly) to the base 300. For instance, in some embodiments, the base 300 and the top 302 are a monolithic piece that is formed of any suitable material, for example, a rigid polymer material. The top 302 may generally be configured to interact with the soft close mechanism 200. Additionally, the top 302 may include a main body 310. However, for the embodiment of FIG. 11, the top 302 does not include a tip. Rather, the main body 310 may include, at least in part, an angled leading side 414 and the angled trailing side 416. The angled leading side 414 and the angled trailing side 416 may be spaced apart approximately along the transverse direction T. In this regard, the trigger head 406 may be configured to engage with a soft close mechanism that may be in a horizontal orientation. For instance, the trigger head 406 may be configured to engage with the soft close mechanism 200 in the horizontal orientation as illustrated in FIG. 10.

The angled leading side 414 may include a first portion 418 and a second portion 420. The first portion 418 of the angled leading side 414 and the second portion 420 of the angled leading side 414 may define a predetermined angle 422 therebetween. In some embodiments, the first portion 418 of the angled leading side 414 is extended along or approximately parallel to the lateral direction L. Additionally, in some embodiments, the second portion 420 of the angled leading side 414 is extended from the first portion 318 at the predetermined angle 422. The predetermined angle 422 may be any suitable angle (e.g., greater than 0°) that may form the angle trailing side 316. For instance, in some embodiments, e.g., FIG. 11, the predetermined angle 422 is an obtuse angle (e.g., an angle which is greater than ninety degrees (90°) and less than one hundred eighty degrees (180°)).

Additionally, the angled trailing side 416 may include a first portion 428 and a second portion 430. The first portion 428 of the angled trailing side 416 and the second portion 430 of the angled trailing side 416 may define a predetermined angle 432 therebetween. In some embodiments, the first portion 428 of the angled trailing side 416 is extended along or approximately parallel to the lateral direction L. Additionally, in some embodiments, the second portion 430 of the angled trailing side 416 is extended from the first portion 428 at the predetermined angle 432. The predetermined angle 432 may be any suitable angle that may form the angled trailing side 416. For instance, in some embodiments e.g., FIG. 11, the predetermined angle 432 is an obtuse angle (e.g., an angle which is greater than ninety degrees (90°) and less than one hundred eighty degrees (180°)).

Embodiments of the present subject matter advantageously provide a reset feature for a soft close mechanism of a slide assembly. During a retraction operation of the slide assembly, a trigger assembly of the slide assembly may be configured to engage with a saddle of the soft close mechanism to activate or "trigger" an actuator. Typically, the saddle is configured to hold a trigger head of the trigger assembly during the retraction operation. However, when the actuator of the soft close mechanism is unintentionally or accidentally triggered (e.g., a "false" trip), the actuator may retract prior to the trigger head being held within the saddle. Accordingly, embodiments of the present subject matter advantageously provide a trigger head that has an angled leading side. The angled leading side can contact the front edge of the saddle and allow the saddle to deflect around the trigger head. After passing the front edge of the saddle, the trigger head will return to its intended position relative to the soft close mechanism.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a vertical direction, a lateral direction, and a transverse direction, the dishwashing appliance comprising:
- a tub defining a wash chamber;
- a rack assembly positioned within the wash chamber;
- a slide assembly comprising a soft close mechanism in a vertical orientation, wherein the slide assembly is mounted to the tub, wherein the rack assembly is slidably mounted to the slide assembly to transition the rack assembly between an extended loading position and a retracted position, and wherein the soft close mechanism comprising an actuator to dampen movement of the slide assembly; and
- a trigger assembly, the trigger assembly comprising:
  - a trigger support arm attached to the slide assembly; and
  - a trigger head attached to the trigger support arm, the trigger head comprising:
    - a base comprising a first leg, a second leg, and an arm, wherein the arm is positioned between the first leg and the second leg approximately along the transverse direction, and
    - a top attached to the base, the top comprising a main body and a tip extended from the main body approximately along the lateral direction, the tip comprising an angled leading side and a trailing side spaced apart approximately along the transverse direction.

2. The dishwashing appliance of claim 1, wherein the angled leading side comprises a first portion and a second portion and wherein the first portion and the second portion define a predetermined angle therebetween.

3. The dishwashing appliance of claim 2, wherein the second portion comprises a first leading edge and a second leading edge spaced apart approximately along the vertical direction.

4. The dishwashing appliance of claim 3, wherein the second leading edge is chamfered.

5. The dishwashing appliance of claim 1, wherein the first leg, the second leg, and the arm define a slot and wherein the trigger support arm is attached to the trigger head within the slot.

6. The dishwashing appliance of claim 1, wherein the soft close mechanism comprises a saddle coupled to the actuator.

7. The dishwashing appliance of claim 6, wherein the saddle comprises a front edge and a rear edge.

8. The dishwashing appliance of claim 7, wherein the angled leading side is engaged with the front edge of the soft close mechanism to reset the soft close mechanism following a false trip failure mode of the soft close mechanism.

9. A dishwashing appliance defining a vertical direction, a lateral direction, and a transverse direction, the dishwashing appliance comprising:

a tub defining a wash chamber;

a rack assembly positioned within the wash chamber;

a slide assembly comprising a soft close mechanism in a horizontal orientation, wherein the slide assembly is mounted to the tub, wherein the rack assembly is slidably mounted to the slide assembly to transition the rack assembly between an extended loading position and a retracted position, and wherein the soft close mechanism comprising an actuator to dampen movement of the slide assembly; and a trigger assembly, the trigger assembly comprising:

a trigger support arm attached to the slide assembly;

a trigger head attached to the trigger support arm, the trigger head comprising:

a base comprising a first leg, a second leg, and an arm, wherein the arm is positioned between the first leg and the second leg approximately along the transverse direction; and a top attached to the base, the top comprising an angled leading side and a trailing side spaced apart approximately along the transverse direction.

10. The dishwashing appliance of claim 9, wherein the angled leading side comprises a first portion and a second portion and wherein the first portion and the second portion define a predetermined angle therebetween.

11. The dishwashing appliance of claim 9, wherein the first leg, the second leg, and the arm of the base define a slot and wherein the trigger support arm is attached to the trigger head within the slot.

12. The dishwashing appliance of claim 9, wherein the soft close mechanism comprises a saddle coupled to the actuator.

13. The dishwashing appliance of claim 12, wherein the saddle comprises a front edge and a rear edge.

14. The dishwashing appliance of claim 13, wherein the angled leading side of the trigger head is engaged with the front edge of the soft close mechanism to reset the soft close mechanism following a false trip failure mode of the soft close mechanism.

15. A trigger assembly of a slide assembly for a dishwashing appliance defining a vertical direction, a lateral direction, and a transverse direction, the trigger assembly comprising:

a trigger support arm attached to the slide assembly of the dishwashing appliance, wherein the trigger support arm defines a hole therethrough;

a trigger head attached to the trigger support arm, the trigger head comprising:

a base comprising a first leg, a second leg, and an arm, wherein the arm is positioned between the first leg and the second leg approximately along the transverse direction, wherein the first leg, the second leg, and the arm define a slot, wherein the arm comprises a pin extending approximately along the lateral direction into the slot; and a top attached to the base, the top comprising a main body and a tip extended from the main body approximately along the lateral direction, the tip comprising an angled leading side and a trailing side spaced apart approximately along the transverse direction, wherein the trigger head is attached to the trigger support arm within the slot.

16. The trigger assembly of claim 15, wherein the angled leading side comprises a first portion and a second portion and wherein the first portion and the second portion define a predetermined angle therebetween.

17. The trigger assembly of claim 16, wherein the second portion comprises a first leading edge and a second leading edge spaced apart approximately along the vertical direction.

18. The trigger assembly of claim 17, wherein the second leading edge is chamfered.

* * * * *